US011452396B2

(12) United States Patent
Randall

(10) Patent No.: US 11,452,396 B2
(45) Date of Patent: Sep. 27, 2022

(54) DRINKING VESSEL HOLDER ASSEMBLY

(71) Applicant: Sean Gordon Randall, Red Hill (AU)

(72) Inventor: Sean Gordon Randall, Red Hill (AU)

( * ) Notice: Subject to any disclaimer, the term of this patent is extended or adjusted under 35 U.S.C. 154(b) by 0 days.

(21) Appl. No.: 16/975,002

(22) PCT Filed: Feb. 18, 2019

(86) PCT No.: PCT/AU2019/050130

§ 371 (c)(1),
(2) Date: Aug. 21, 2020

(87) PCT Pub. No.: WO2019/161440

PCT Pub. Date: Aug. 29, 2019

(65) Prior Publication Data

US 2020/0390258 A1 Dec. 17, 2020

(30) Foreign Application Priority Data

Feb. 21, 2018 (AU) ..... 2018900548

(51) Int. Cl.

| | |
|---|---|
| ***A47G 23/02*** | (2006.01) |
| ***B65D 23/08*** | (2006.01) |
| ***B65D 81/38*** | (2006.01) |

(52) U.S. Cl.

CPC ..... *A47G 23/0241* (2013.01); *B65D 23/0842* (2013.01); *B65D 81/3876* (2013.01); *A47G 2023/0275* (2013.01)

(58) Field of Classification Search

CPC ..... A47G 23/0241; A47G 2023/0275; B65D 23/0842; B65D 81/3876

(Continued)

(56) References Cited

U.S. PATENT DOCUMENTS 5,297,695 A * 3/1994 Provence ..... B44D 3/123 220/23.83
5,533,700 A * 7/1996 Porter ..... B60N 3/101 248/311.2

(Continued)

FOREIGN PATENT DOCUMENTS

AU 2005100314 5/2005
CA 2191781 5/1998

(Continued)

OTHER PUBLICATIONS

International Search Report and Written Opinion for Application No. PCT/AU2019/050130 dated Apr. 1, 2019.

(Continued)

*Primary Examiner* — Don M Anderson
*Assistant Examiner* — Elizabeth J Volz
(74) *Attorney, Agent, or Firm* — Tumey L.L.P.

(57) ABSTRACT

A drinking vessel holder assembly comprising: a base comprising a receiving portion for receiving a lower part of a vessel, the base being provided with one or more connecting portions located along the base; one or more frame members wherein each of said frame members comprises respective locking portions adapted for connection with one or more connecting portions of the base; wherein during use, in an assembled configuration, locking portions of the frame members are adapted to be coupled with respective connecting portions of the base such that the frame members extend upwardly relative to the base to form a vessel holder frame that defines an internal volume to receive the vessel therein.

20 Claims, 10 Drawing Sheets

(58) Field of Classification Search
USPC ..... 248/311.2, 154, 313; 220/737; 215/395, 215/386
See application file for complete search history.

(56) References Cited

U.S. PATENT DOCUMENTS

| | | | | |
|---|---|---|---|---|
| 5,720,516 | A * | 2/1998 | Young | A47G 23/0225 297/188.18 |
| 10,234,505 | B1 | 3/2019 | Shivaray et al. | |
| 2008/0087786 | A1* | 4/2008 | Oas | A47G 23/0216 248/311.2 |
| 2011/0271708 | A1 | 11/2011 | Baker et al. | |
| 2012/0222281 | A1* | 9/2012 | Chitayat | B65F 1/06 29/428 |
| 2014/0061151 | A1* | 3/2014 | Keys | A47G 19/12 215/395 |

FOREIGN PATENT DOCUMENTS

| | | | | |
|---|---|---|---|---|
| WO | 2008003128 | | 1/2008 | |
| WO | 2017021672 | | 2/2017 | |
| WO | WO2017021672 | * | 2/2017 | F16M 13/022 |

OTHER PUBLICATIONS

International Preliminary Report on Patentability for Application No. PCT/AU2019/050130 dated Jun. 5, 2020.

* cited by examiner

DRINKING VESSEL HOLDER ASSEMBLY

TECHNICAL FIELD

The present invention relates to a drinking vessel holder assembly.

BACKGROUND

Any references to methods, apparatus or documents of the prior art are not to be taken as constituting any evidence or admission that they formed, or form part of the common general knowledge.

Drinking vessel holders are used to insulate or protect the hand of the drinker from a cold drinking vessel. Some drinking vessel holders comprise a Neoprene™ sleeve which wraps in direct contact with the drinking vessel. However, there is also a market for more elaborate designs of drinking vessels. People typically prefer not to pour their drinks directly into a novelty drinking vessel.

Accordingly, there is a need for a novelty drinking vessel holder which is adapted to accommodate a drinking vessel of any size and shape since drinking vessels (usually drinking bottles) are manufactured in several sizes and shapes. There is also a need for the novelty drinking vessel holder which is adapted to be transported in a compact and light-weight manner in order to minimize postage costs. Consequently, there is also a need to provide a drinking vessel holder that can be assembled relatively easily.

Furthermore, there is also a need for a drinking vessel holder which does not allow the drinking vessel to fall out of the holder when in use. This problem is particularly concerning, as many popular alcoholic drinking vessels are made of glass and could damage the teeth of the drinker if they slipped out of the holder and jut toward the mouth area. The holder should allow the user to grip the drinking vessel securely within the holder.

A drinking vessel holder which is soft and light-weight is also required, particularly as the holder may be used at venues where the drinkers may become inebriated. The vessel holder should not be capable of unintentionally injuring any one, or at least not appear to be useful as a weapon.

The object of the present invention is to overcome or at least substantially ameliorate the aforementioned problems.

SUMMARY OF INVENTION

In an aspect, the invention provides a drinking vessel holder assembly comprising:

a base comprising a receiving portion for receiving a lower part of a vessel, the base being provided with one or more connecting portions located along the base;

one or more frame members wherein each of said frame members comprises respective locking portions adapted for connection with one or more connecting portions of the base;

wherein during use, in an assembled configuration, locking portions of the frame members are adapted to be coupled with respective connecting portions of the base such that the frame members extend upwardly relative to the base to form a vessel holder frame that defines an internal volume to receive the vessel therein.

In an embodiment, one or more connecting portions are located substantially along a peripheral region of the base.

In an embodiment, the base comprises one or more side walls extending from an in-use lower part of the base to an in-use upper part of the base, the side walls being adapted to engage with the lower part of the vessel.

In one embodiment, one or more said side walls converge downwardly and inwardly from the in-use upper part to the in-use lower part of the base.

Preferably, a plurality of spaced ridges are located in between the in-use upper part and lower part of the base to receive and engage the lower part of the vessel positioned in the internal volume defined by the vessel holder frame.

In an embodiment, the connecting portions are radially arranged along peripheral regions of the in-use upper part of the base.

In an embodiment, the locking portion of each frame member can be press fitted into the connecting portion of the base.

In an embodiment, the connecting portions comprise an aperture or a slot adapted to receivably engage the locking portions of said one or more frame members.

In an embodiment, the aperture or the slot and the locking portion are shaped to limit inward and outward movement of the locking portion within the slot or the aperture.

In an embodiment, during use, the locking portion extends downwardly relative to a body of the frame member towards and into the aperture or slot of the base.

In an embodiment, the frame member comprises an inwardly directed end portion wherein the locking portion extends downwardly from the inwardly directed end portion.

Preferably, the drinking vessel holder assembly further comprises strengthening ribs extending between the inwardly directed end portion such that an inner surface of the body of the frame member.

In an embodiment, upon being coupled to the connecting portions of the base, the frame members are adapted to flex and press against the vessel positioned in the internal volume of the vessel holder frame.

In an embodiment, a lower part of the base comprises an opening extending therethrough to allow drainage of condensation or spillage.

Preferably, the base and or the frame members comprise one or more channels for directing spillage or condensation towards the opening of the base.

In an embodiment, the frame members are curved such that in the assembled configuration the curved frame members coupled with the base define a substantially ovoid or spherical volume.

In another embodiment, the frame members are shaped such that in the assembled configuration the frame members coupled with the base define a pyramidal or prism shaped volume.

In an embodiment, the drinking vessel holder assembly further comprises a flexible sleeve (cover) wherein in the assembled configuration the vessel holder frame is adapted to receive said sleeve thereon and at least partially enclose the internal volume defined by the vessel holder frame.

In an embodiment, the sleeve comprises an insulating material to insulate contents of the vessel positioned in the internal volume of the vessel holder frame.

Preferably, the sleeve comprises an opening for allowing the vessel to be positioned into the internal volume of the vessel holder frame.

In an embodiment, the drinking vessel holder assembly further comprises a fastener to open and/or close the opening of the sleeve.

In an embodiment, the sleeve comprises a plurality of panels stitched together.

In an embodiment, the base comprises a channel for accommodating stitched seams of the sleeve.

In an embodiment, the sleeve comprises panels that can be decorated via sublimation printing, badges, patchwork, LED or OLED lighting panels.

In an embodiment, the sleeve is substantially elastic to allow the sleeve to be snug-fitted over the vessel holder frame.

In an embodiment, the sleeve is machine washable.

In an embodiment, length of at least one of the frame members is less than length of one or more of the other frame members to allow loading of the vessel.

Preferably, length of the other frame members is equal.

BRIEF DESCRIPTION OF THE DRAWINGS

Preferred features, embodiments and variations of the invention may be discerned from the following Detailed Description which provides sufficient information for those skilled in the art to perform the invention. The Detailed Description is not to be regarded as limiting the scope of the preceding Summary of the Invention in any way. The Detailed Description will make reference to a number of drawings as follows.

DETAILED DESCRIPTION OF PREFERRED EMBODIMENTS

Figure 1:
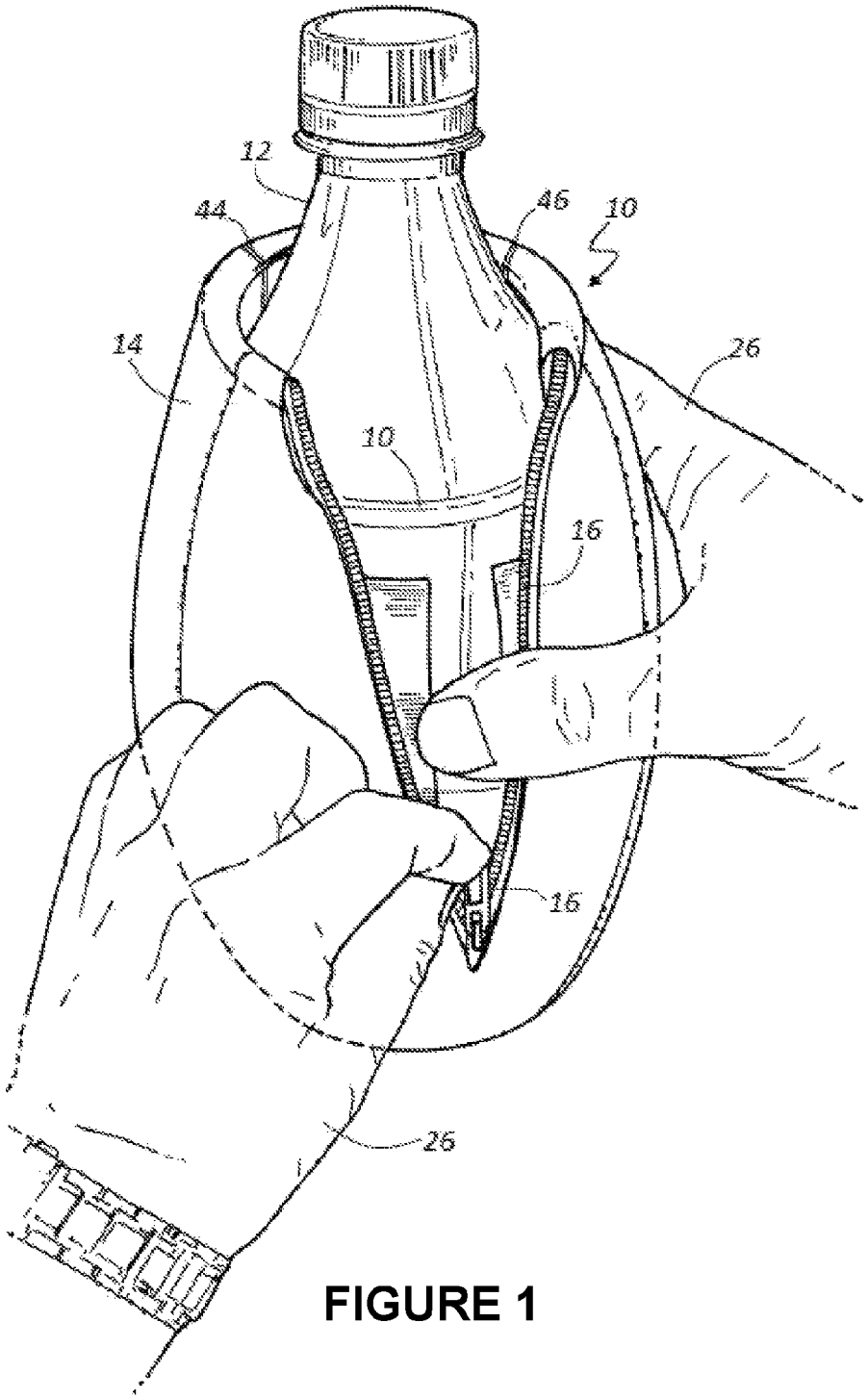
FIG. 1 is a perspective external view of a first embodiment of the drinking vessel holder assembly 10 of the present invention.
Figure 2:
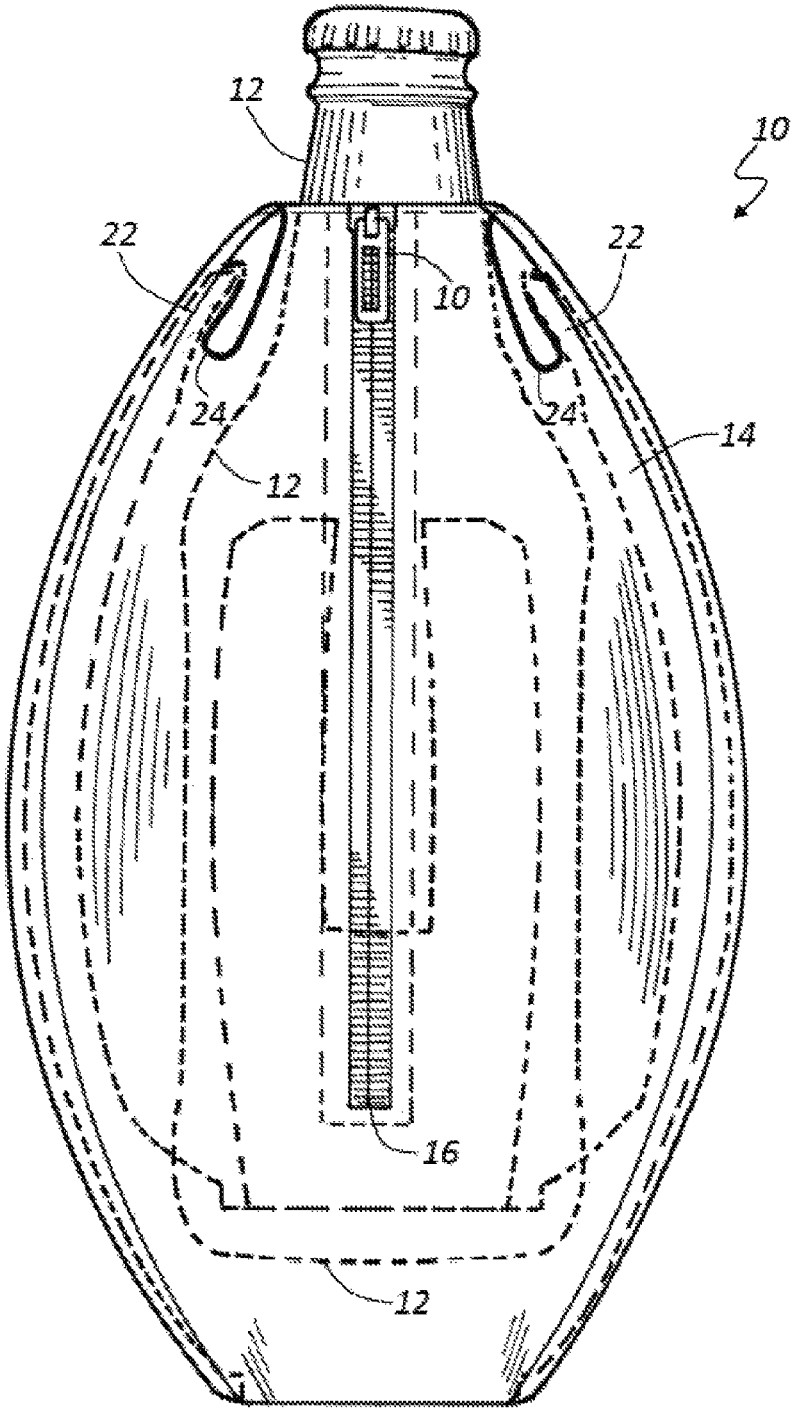
FIG. 2 is a side view of the drinking vessel holder assembly of FIG. 1.
Figure 3:
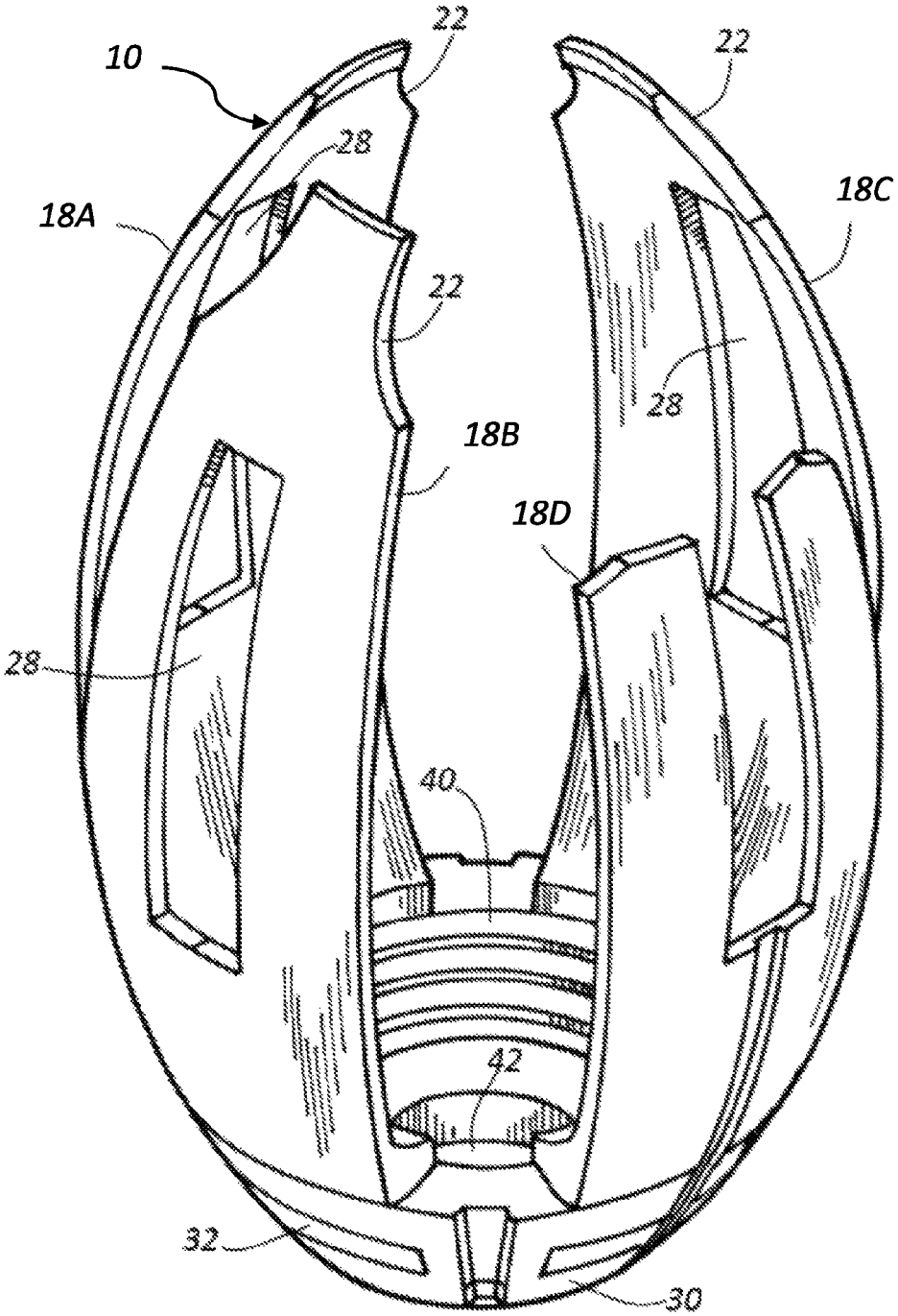
FIG. 3 is a perspective internal view of the drinking vessel holder assembly of FIG. 1.
Figure 4:
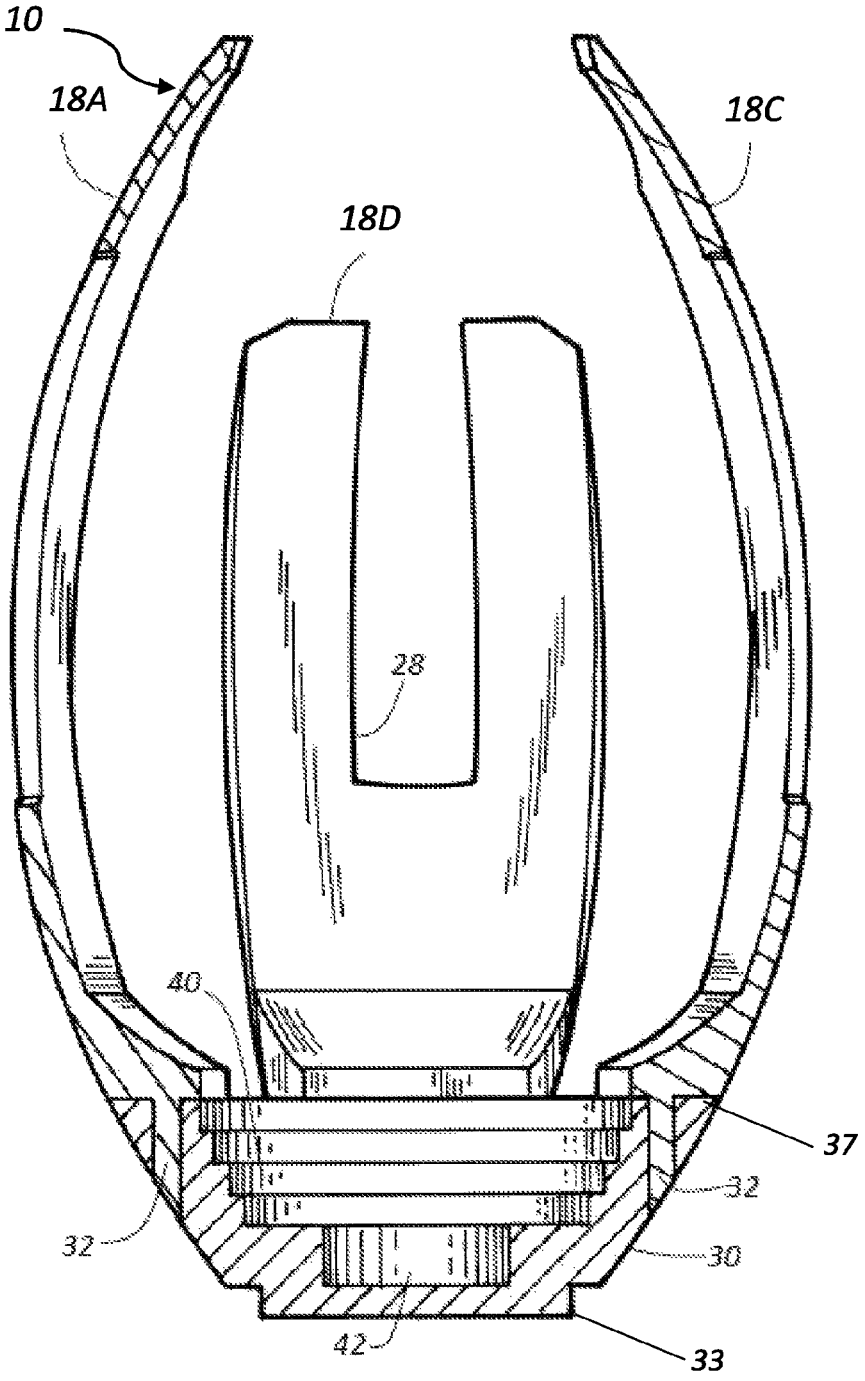
FIG. 4 is a side section internal view of the drinking vessel holder assembly of FIG. 1.
Figure 5:
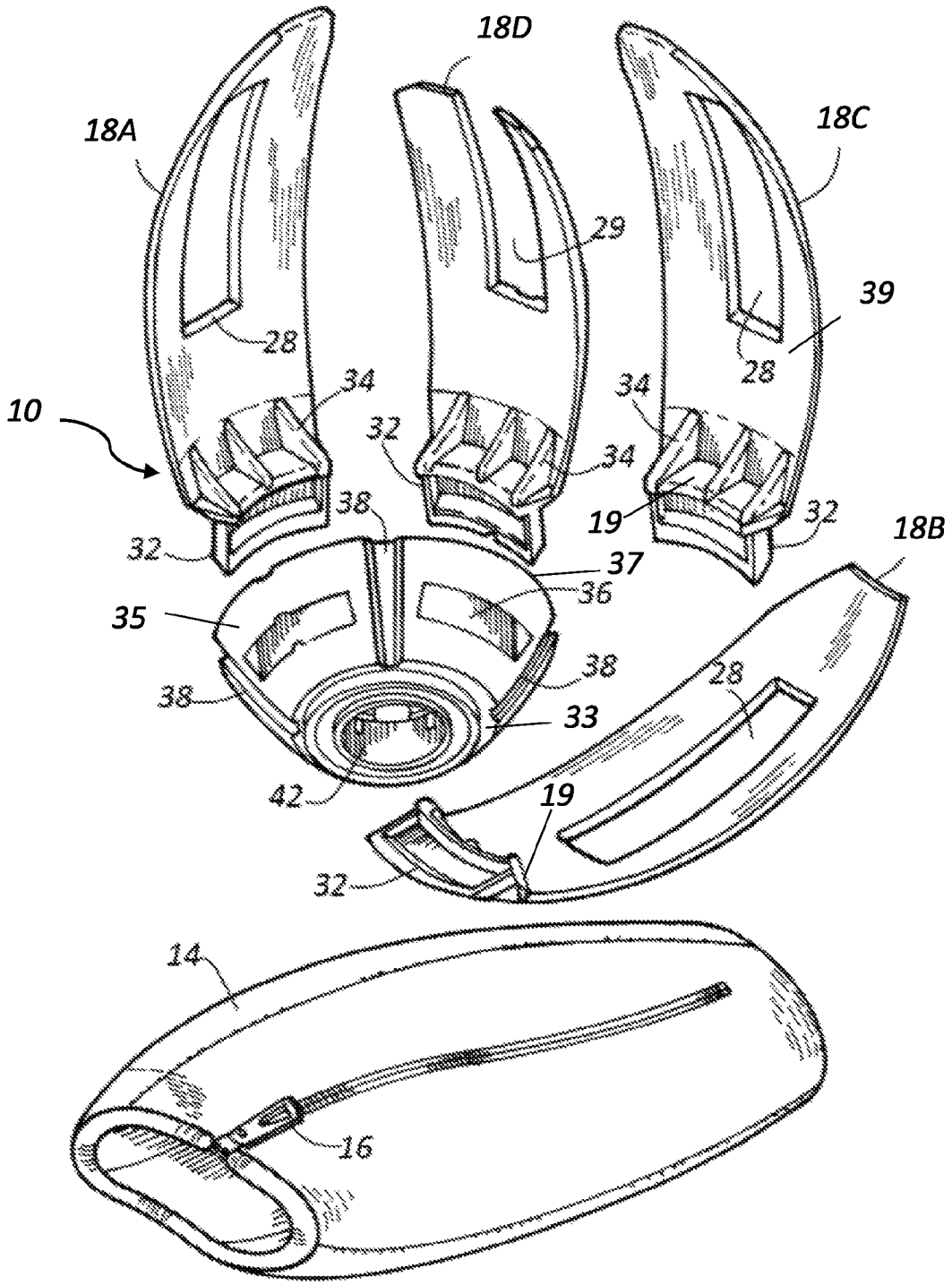
FIG. 5 is an exploded perspective view of the drinking vessel holder assembly of FIG. 1.
Figure 6:
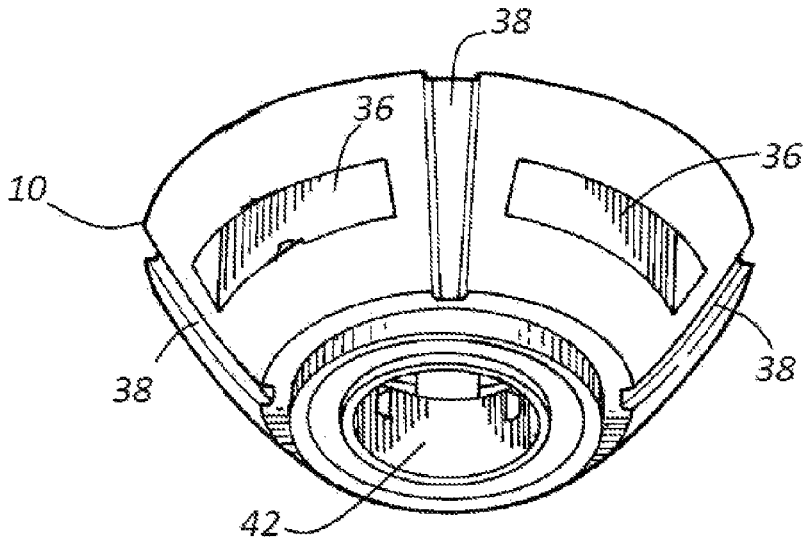
FIG. 6 is a perspective internal view of the base of the drinking vessel holder assembly of FIG. 1.
Figure 7:
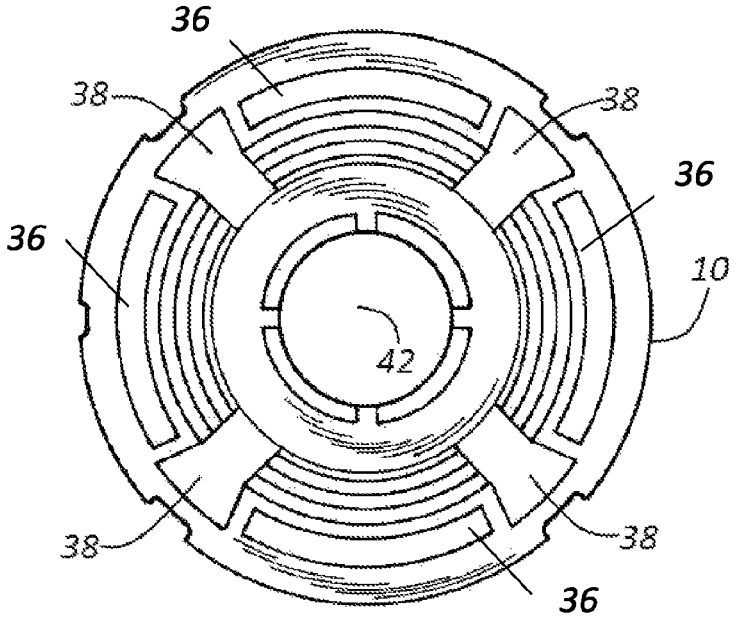
FIG. 7 is a top internal view of the base of the drinking vessel holder assembly of FIG. 1.

FIGS. 1 to 8 illustrate a drinking vessel holder assembly 10 according to an embodiment of the present invention for a drinking vessel 12 (shown in FIGS. 1 and 2).

The drinking vessel holder assembly 10 comprises a novel structural configuration that allows the assembly to be assembled from an initially dismantled configuration as will be explained in the foregoing sections. The ability to dismantle the vessel holder frame allows the vessel holder 10 to be packaged in a compact (preferably flat-pack) configuration for transportation.

The drinking vessel holder assembly 10 comprises a base 30 (FIGS. 3 to 8) that is adapted to receive a lower part of the vessel 12 when the base 30 has been coupled with a plurality of the upstanding frame members 18A, 18B, 18C and 18D (generally denoted by reference numeral 18 throughout the specification) to form the vessel holder frame that defines an internal volume to receive the vessel 12 (shown in FIGS. 1 and 2).

Figure 8:
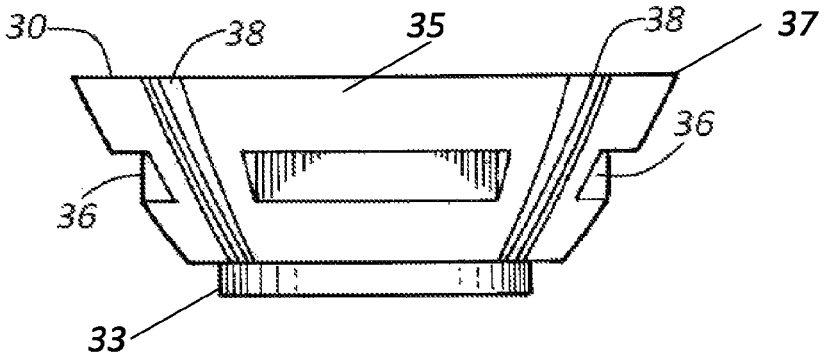
FIG. 8 is a side internal view of the base of the drinking vessel holder assembly of FIG. 1.

The base 30 comprises an in-use lower part 33 with side walls 35 extending upwardly from the in-use lower part 33 to an in-use upper part 37 of the base 30 as shown in FIG. 8. The side walls 35 converge downwardly and inwardly from the in-use upper part 37 to the in-use lower part 33 of the base 30 (see FIGS. 4 to 6) and includes a plurality of spaced ridges 40 located in between the in-use upper part 37 and lower part 33 of the base 30 to receive and engage the lower part of the vessel positioned in the internal volume of the vessel holder frame. The provision of the spaced apart ridges 40 along the inwardly convergent side wall 35 allows the base 30 to accommodate different sized bases (with varying diameters) of various drinking vessels 12. The ridges 40 may be spaced apart at regular or irregular intervals. During use, the ridges 40 engage the outer surface of the base portion of the drinking vessel 12 and prevent the vessel 12 from being unstable or slipping when placed within the internal volume of the vessel holder frame and becoming dislodged or misaligned within the vessel holder 10. The ridges 40 thereby reduce the risk of spillage of the drinking vessel 12 and injury to the mouth of the user 26 by engaging with the base of the drinking vessel 12 and reduce the chances of movement of the drinking vessel 12.

The base 30 also includes connecting portions provided in the form of radially arranged apertures 36 positioned along the upper part 37 of the base 30. Each of the apertures 36 is adapted to be coupled with respective frame members 18 to form the vessel holder frame. Specifically, each frame member 18 includes locking portions provided in the form of locking tongues 32 which extend in an in-use downwardly direction and are adapted to be press-fitted into a respective aperture 36 of the base 30. In the preferred embodiment, the base 30 includes four radially arranged apertures 36. Each aperture 36 receives the locking tongue 32 on each respective frame member 18 (including four frame members 18A, 18B, 18C and 18D).

It must be noted that the number of apertures 36 and the number of corresponding frame members 18 is not limited in any manner whatsoever. Furthermore, the connecting arrangement for coupling the base 30 with the frame members 18 is also not limiting. By way of example, in alternative embodiments, the base 30 may be provided with protruding connecting members that may be press-fitted (or coupled in any other way) or received into openings provided on the frame members 18.

The locking tongue 32 extends downwardly relative to the curved (or arc shaped) body portion 39. Each of the frame members 18 includes an inwardly directed shoulder portion 19 that extends inwardly from the body portion 39 of the frame member 18. The locking tongue 32 extends downwardly from the inwardly directed shoulder portion 19 and functions as a stop to limit inward movement of the locking tongue 32 as it is received into the aperture 36. Strengthening ribs 34 extend between the inwardly directed shoulder portion 19 and an inner side of the frame member 18. The ribs 34 also function like a hinge and allow the coupled frame members 18 to flex and press against the vessel 12's neck positioned in the internal volume of the vessel holder frame 10 during use.

The lower part 33 of the base 30 also includes a centrally positioned opening in the form of a drain hole 42 which allows for the drainage of condensation or spillage from the drinking vessel 12 during particularly during periods of prolonged use. The provision of the drain hole 42 also reduces the weight of the base 30. The lower part 33 of base 30 is flat, so that the drinking vessel holder 10 can be placed on a flat surface without rocking and spilling the drink within the drinking vessel 12.

The vessel holder assembly 10 also comprises an insulated flexible sleeve 14 that can be positioned over the vessel holder frame in order to enclose and insulate the vessel 12 positioned within the internal volume defined by the frame members 18A to 18D and the base 30 when the base 30 and the frame members 18A to 18D are coupled with each other in the assembled configuration. During use, the sleeve 14 wraps around the frame members 18A to 18D and the side walls 35 of the base to insulate the vessel 12. A neck 22 of the long ribs 18 fits within pockets 24 in the inner lining at the top of the sleeve 14 to keep the sleeve 14 in position over the long ribs 18 (see FIG. 2).

Referring to FIG. 1, the short frame member 18D (one of the frame members 18 has a smaller length/height compared with the length/height of the remaining frame members) faces a fastener provided in the form of a zip 16 provided on the sleeve 14, so that when the zip 16 is pulled down, a user can insert the drinking vessel 12 in through the top of the holder 10. Without the short rib 18D, it would be difficult for a user 26 to insert the wide base of the drinking vessel 12 into the top of the holder 10 with one hand.

The relatively longer frame members 18A to 18C include apertures 28. The short rib 18D also has an aperture 29. The apertures 28 and 29 are primarily designed to minimize the amount of plastic material used in the manufacture of the vessel holder frame 10 and thereby reduce the weight and costs of its construction and the cost of mailing the vessel holder 10 to purchasers. In addition, the aperture 28 provides a depression for the fingers of the user 26. The reduction in weight of the holder as a result of the apertures 28 or 29 also makes the holder 10 more enjoyable to use. In addition, it is advantageous to reduce the weight of the holder 10 because it is anticipated that the holder 10 will be used for alcoholic beverages particularly at sporting venues. Reduction of the weight of the vessel holder frame reduces the likelihood of the vessel holder 10 being used a projectile or weapon by unruly spectators at a sporting venue.

The sleeve 14 also has slits 44 and 46 which enable the sleeve 14 to expand if a drinking vessel has a wide neck. The slits 44 and 46 enable the zipper 16 to be completely closed around the wide neck. For example, beer bottles often have slender necks and lower volumes, but sports drink bottles often have wider necks and larger volumes. If the zipper 16 is completely closed, the drinking vessel of any size is more likely to stay firmly in position within the holder 10. Fluorescent paint, electric lights, or an LED lighting panel could be affixed to the sleeve 14. The sleeve 14 could be made of an Organic Light-Emitting Diode (OLED) panel to represent various different signs on a dynamic screen.

The base 30 has apertures 36 which are adapted to receive the tongues 32. The base 30 also has channels 38 which are adapted to receive the inner seams (which are not shown) adjoining the sections of material comprising the sleeve 14. The channels 38 prevent the seams of the sleeve 14 from protruding from the holder 10, which would otherwise reduce its aesthetic appeal.

The shape of the frame members 18 and the base 30 is not limiting. For example, the frame members 18 from the first embodiment could be formed into a spherical shape. The sleeve 14 could be customized to represent a soccer ball, cricket ball, disco ball, world globe, basketball, snooker ball.

Figure 9:
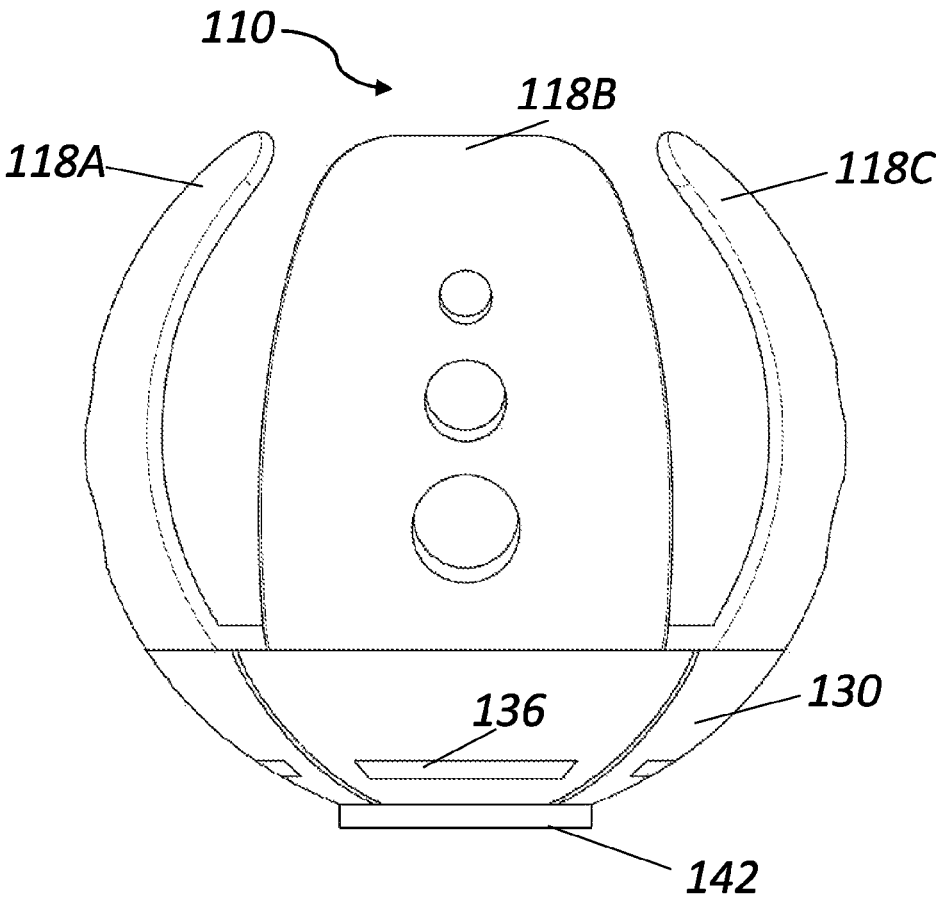
FIG. 9 is a side view of a drinking vessel assembly 110 in accordance with a second embodiment.
Figure 10:
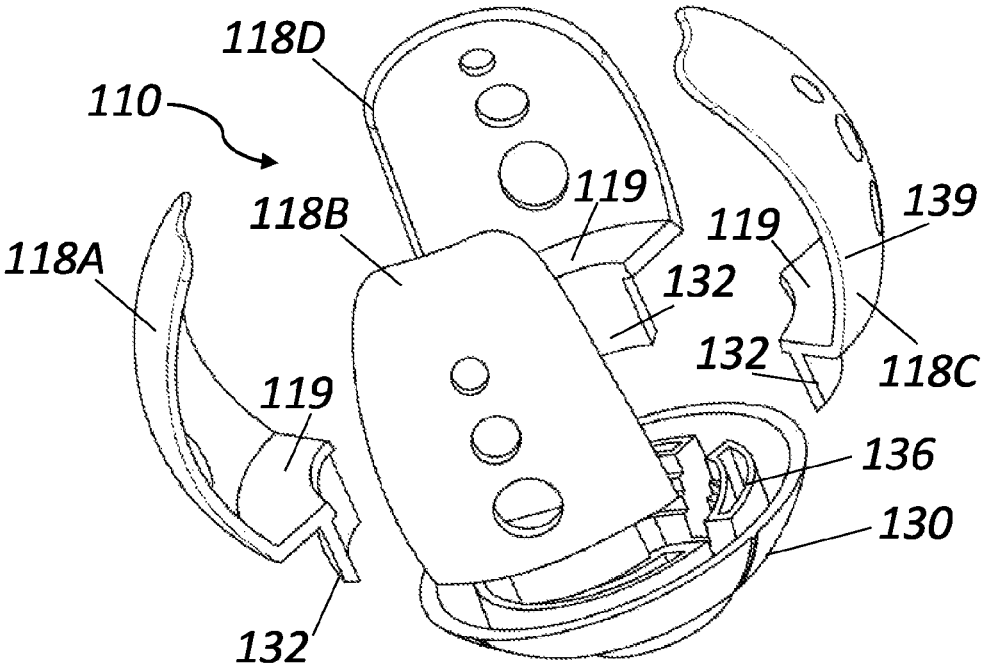
FIGS. 10 and 11 are exploded perspective views of the vessel holder assembly 110.
Figure 11:
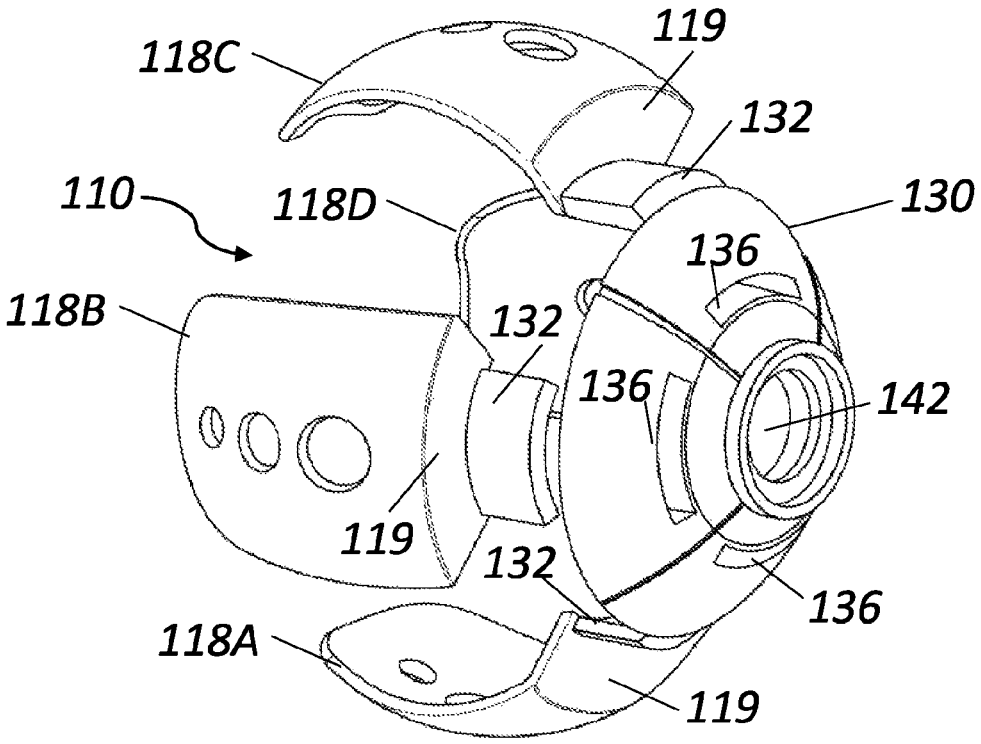

Referring to FIGS. 9 to 11, a second embodiment of a vessel holder assembly 110 is illustrated. Like reference numerals denote like features.

The drinking vessel holder assembly 110 comprises a base 130 that is adapted to receive a lower part of a vessel (such as vessel 12—as previously discussed) when the base 130 has been coupled with a plurality of the upstanding frame members 118A, 118B, 118C and 118D (generally denoted by reference numeral 118 throughout the specification) to form the vessel holder frame that defines a substantially hollow spherical internal volume.

Each frame member 118 includes locking tongues 132 which extend in an in-use downwardly direction and are adapted to be press-fitted into a respective aperture 136 of the base 130. In the preferred embodiment, the base 130 includes four radially arranged apertures 136. Each aperture 136 receives a respective frame member 118 (including four frame members 118A, 118B, 118C and 118D). The locking tongue 132 also extends downwardly relative to the curved (or arc shaped) body portion 139. Each of the frame members 118 also includes an inwardly directed shoulder portion 119 that extends inwardly from the body portion 139 of the frame member 118. The locking tongue 132 extends downwardly from the inwardly directed shoulder portion 119 and functions as a stop to limit inward movement of the locking tongue 132 as it is received into the aperture 136. The shoulder portion 119 allows the body portion 139 to flex relative to the locking tongue 132 thereby allowing the user to press the frame members 118 which in turn allows the user to have a firmer or tighter grip on the vessel (such as vessel 12) positioned in the vessel holding frame (formed by coupling the base 30 with the frame members 118). As explained in the earlier sections, a sleeve may be positioned above the vessel holder frame 110 shown in FIGS. 9 to 11 in order to provide an insulated drinking vessel holder assembly that is substantially spherical in shape.

Figure 12:
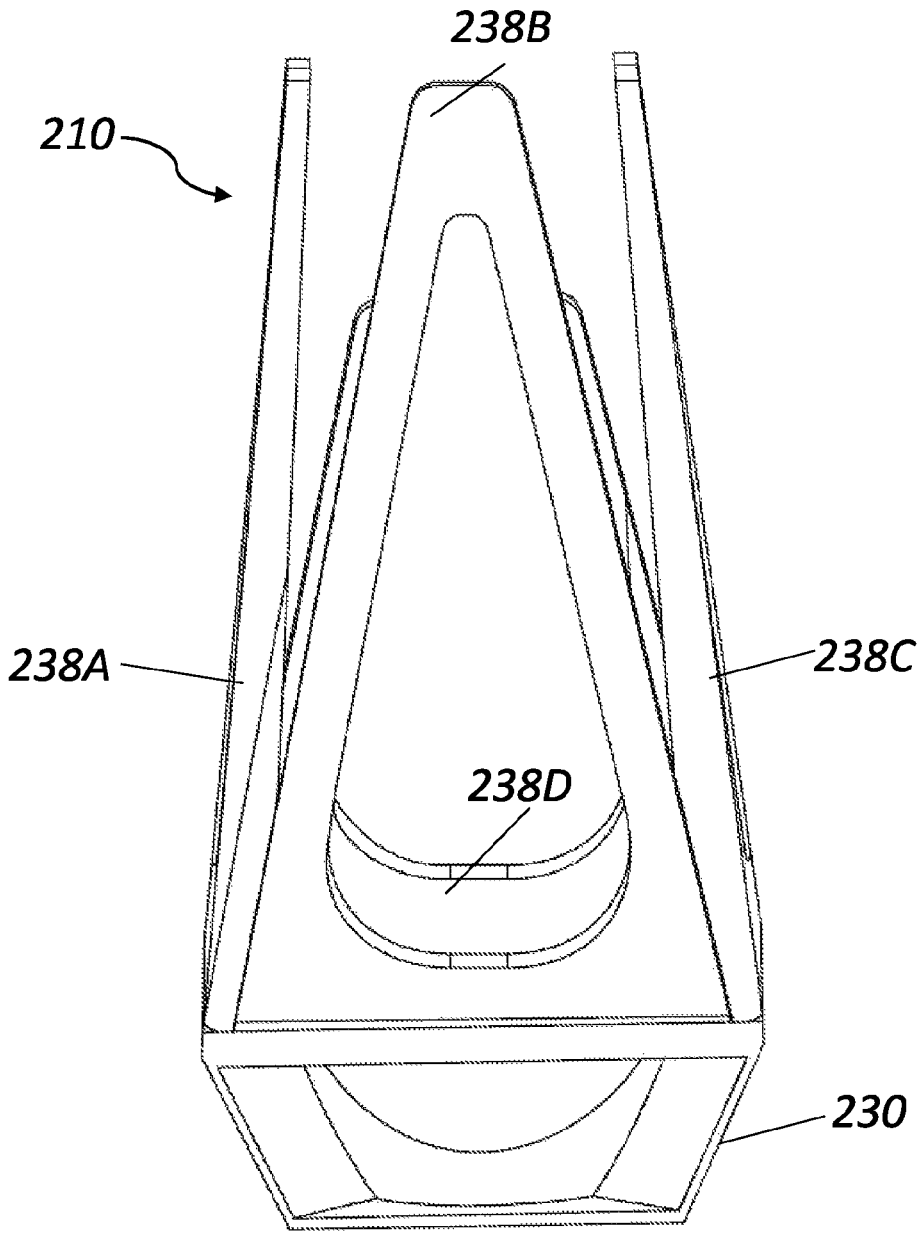
FIG. 12 is a side view of a drinking vessel assembly 210 in accordance with a second embodiment.
Figure 13:
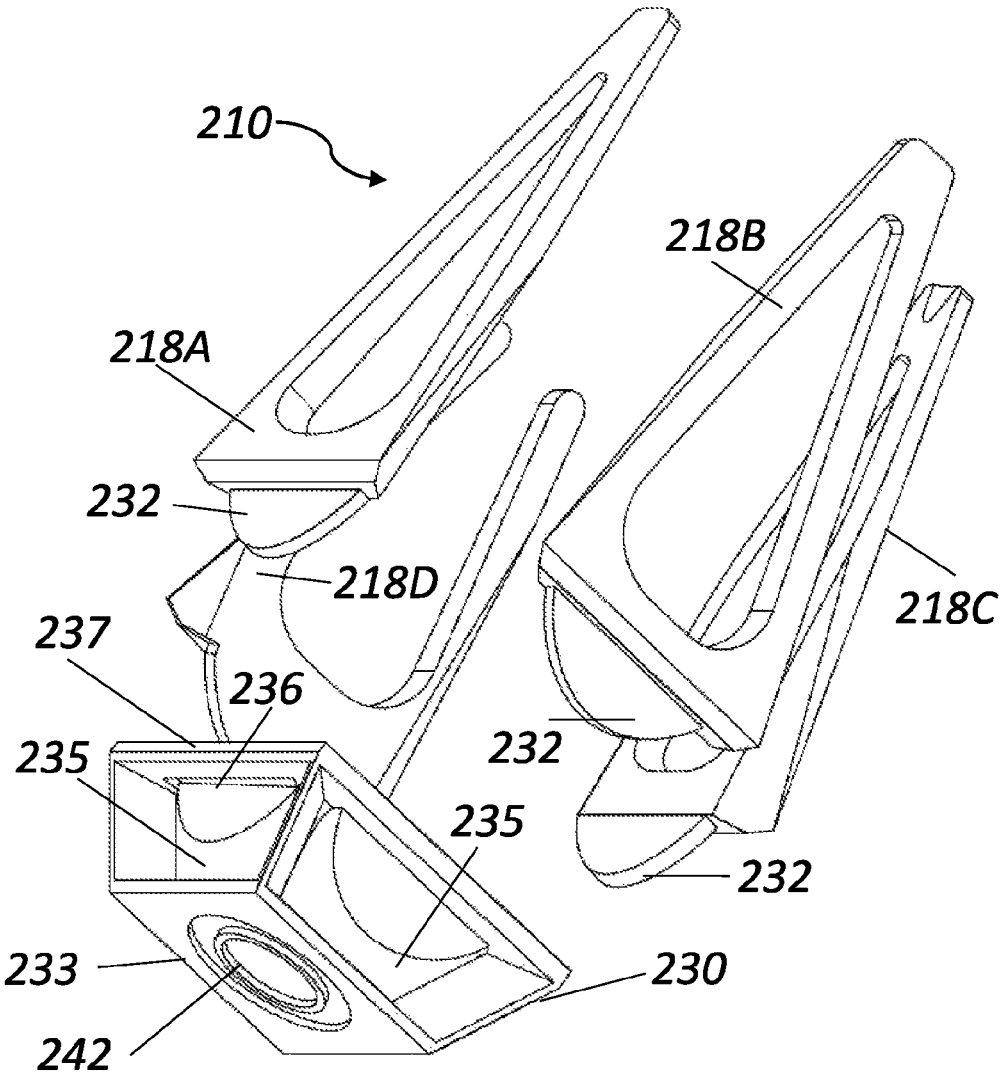
FIG. 13 is an exploded view of the drinking vessel assembly 210.

Referring to FIGS. 12 and 13 yet another embodiment of a drinking vessel holder assembly 210 is illustrated wherein the base 230 comprises four side walls 235 that converge downwardly and inwardly towards a square shaped and flat lower portion 233. Each of the four side walls 235 include a plurality of spaced ridges 240 located in between the in-use upper part 237 and lower part 233 of the base 230 to receive and engage the lower part of the vessel (such as vessel 12 as discussed in earlier sections) positioned in the internal volume of the vessel holder frame. The provision of the spaced apart ridges along the inwardly convergent side walls 235 allows the base 230 to accommodate different sized bases of various drinking vessels 12 in the same manner as previously discussed.

The base 230 also includes connecting portions provided in the form of peripherally arranged apertures 236 positioned along the upper part 237 of the base 230. Each of the apertures 236 is adapted to be coupled with respective frame members 218 to form the pyramid shaped vessel holder frame. Specifically, each frame member 218 includes locking portions provided in the form of locking tongues 232 which extend in an in-use downwardly direction and are adapted to be press-fitted into a respective aperture 236 of the base 230. In the preferred embodiment, the base 230 includes four radially arranged apertures 236 and each aperture 236 receives a respective frame member 218 (including four frame members 218A, 218B, 218C and 218D). One of the frame members, specifically 218D has a smaller length when compared with the other frame members 218A to 218C to provide a larger opening that assists with the insertion of a wide base of a drinking vessel (such as the vessel 12 as previously discussed) into the top of the internal volume defined by the frame members 218A to 218D and the base 230 (in an assembled configuration).

In compliance with the statute, the invention has been described in language more or less specific to structural or methodical features. The term "comprises" and its variations, such as "comprising" and "comprised of" is used throughout in an inclusive sense and not to the exclusion of any additional features.

It is to be understood that the invention is not limited to specific features shown or described since the means herein described comprises preferred forms of putting the invention into effect.

The invention is, therefore, claimed in any of its forms or modifications within the proper scope of the appended claims appropriately interpreted by those skilled in the art.

What is claimed is:

1. A drinking vessel holder assembly comprising:

a base comprising a receiving portion for receiving a lower part of a vessel, the base being provided with one or more connecting portions located along the base wherein the base comprises one or more side walls converging downwardly and inwardly from an in-use upper part of the base to an in-use lower part of the base, the side walls being adapted to engage with the lower part of the vessel;

a plurality of frame members wherein each of said frame members comprises respective locking portions adapted for detachable connection with one or more connecting portions of the base;

wherein during use, in an assembled configuration, locking portions of the frame members are adapted to be coupled with respective connecting portions of the base such that the frame members extend upwardly relative to the base to form a vessel holder frame that defines an internal volume to receive the vessel therein.

2. A drinking vessel holder assembly in accordance with claim 1 wherein said one or more connecting portions are located substantially along a peripheral region of an upper part of the base.

3. A drinking vessel holder assembly in accordance with claim 1 comprising a plurality of spaced ridges located in between the in-use upper part and lower part of the base to receive and engage the lower part of the vessel positioned in the internal volume defined by the vessel holder frame.

4. A drinking vessel holder assembly in accordance with claim 1 wherein the connecting portions are radially arranged along peripheral regions of the in-use upper part of the base.

5. A drinking vessel holder assembly in accordance with claim 1 wherein the locking portion of each frame member can be press fitted into the connecting portion of the base.

6. A drinking vessel holder assembly in accordance with claim 1 wherein the connecting portions comprise an aperture or a slot adapted to receivably engage the locking portions of said one or more frame members.

7. A drinking vessel holder assembly in accordance with claim 6 wherein the apertures or the slots and the locking portion are shaped to limit inward movement of the locking portion within the slot.

8. A drinking vessel holder assembly in accordance with claim 6 wherein during use the locking portion extends downwardly relative to a body of the frame member into the aperture or slot of the base.

9. A drinking vessel holder assembly in accordance with claim 8 wherein the frame member comprises an inwardly directed end portion such that the locking portion extends downwardly from the inwardly directed end portion of the frame member.

10. A drinking vessel holder assembly in accordance with claim 9 further comprising strengthening ribs extending between the inwardly directed end portion and an inner surface of the body of the frame member.

11. A drinking vessel holder assembly in accordance with claim 1 wherein upon being coupled to the connecting portions of the base, the frame members are adapted to flex and press against the vessel positioned in the internal volume of the vessel holder frame.

12. A drinking vessel holder assembly in accordance with claim 1 wherein a lower part of the base comprises an opening extending there through to allow drainage of condensation or spillage.

13. A drinking vessel holder assembly in accordance with claim 12 wherein the base and or the frame members comprise one or more channels for directing spillage or condensation towards the opening of the base.

14. A drinking vessel holder assembly in accordance with claim 1 wherein the frame members are curved such that in the assembled configuration the curved frame members coupled with the base define a substantially ovoid or spherical volume.

15. A drinking vessel holder assembly in accordance with claim 1 wherein the frame members are shaped such that in the assembled configuration the frame members coupled with the base define a pyramidal or prism shaped volume.

16. A drinking vessel holder assembly in accordance with claim 1 further comprising a flexible sleeve wherein in the assembled configuration the vessel holder frame is adapted to receive said sleeve thereon and at least partially enclose the internal volume defined by the vessel holder frame.

17. A drinking vessel holder assembly in accordance with claim 16 wherein the sleeve comprises an insulating material to insulate contents of the vessel positioned in the internal volume of the vessel holder frame.

18. A drinking vessel holder assembly in accordance with claim 16 wherein the sleeve comprises an opening for allowing the vessel to be positioned into the internal volume of the vessel holder frame.

19. A drinking vessel holder assembly in accordance with any one of the preceding claims wherein length of at least one of the frame members is less than length of one or more of the other frame members to allow loading of the vessel.

20. A drinking vessel holder assembly in accordance with claim 19 wherein length of the other frame members is equal.

* * * * *